US006938772B2

(12) United States Patent
Aiken et al.

(10) Patent No.: US 6,938,772 B2
(45) Date of Patent: Sep. 6, 2005

(54) PORTABLE STORAGE CONTAINER

(75) Inventors: Cynthia R. Aiken, Atlanta, GA (US); William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 10/164,120

(22) Filed: Jun. 4, 2002

(65) Prior Publication Data

US 2003/0230510 A1 Dec. 18, 2003

(51) Int. Cl.[7] ..... B65D 21/032
(52) U.S. Cl. ..... 206/506
(58) Field of Search ..... 206/507, 505, 206/506

(56) References Cited

U.S. PATENT DOCUMENTS

| | | | |
|---|---|---|---|
| 2,029,746 | A | 2/1936 | Tufts et al. |
| 2,061,414 | A | 11/1936 | Tufts et al. |
| 2,134,875 | A | 11/1938 | Henze |
| 2,609,120 | A | 9/1952 | Williams |
| 3,220,603 | A | 11/1965 | Bromley |
| 3,323,673 | A | 6/1967 | Cowan |
| 3,940,018 | A | 2/1976 | Schoeller |
| 3,951,265 | A | 4/1976 | Carroll |
| 4,106,623 | A | 8/1978 | Carroll |
| 4,109,791 | A | 8/1978 | Clipson et al. |
| 4,241,831 | A | 12/1980 | Locatelli |
| 4,247,004 | A | 1/1981 | Bird |
| 4,391,369 | A | 7/1983 | Stahl et al. |
| 4,423,813 | A | 1/1984 | Kreeger et al. |
| 4,466,541 | A | 8/1984 | Tabler et al. |
| 4,573,577 | A | 3/1986 | Miller |
| RE32,223 | E | 8/1986 | Kreeger et al. |
| 4,643,310 | A | 2/1987 | Deaton et al. |
| 4,759,451 | A | 7/1988 | Apps |
| 4,770,300 | A | 9/1988 | Klein |
| 4,848,578 | A | 7/1989 | Schafer |
| 4,863,062 | A | 9/1989 | Holliday |
| 4,905,833 | A | 3/1990 | Kreeger et al. |
| 4,947,992 | A | 8/1990 | Schafer |
| 4,982,844 | A | 1/1991 | Madan et al. |
| 5,083,666 | A | 1/1992 | Lam |
| 5,415,293 | A | 5/1995 | Ackermann |
| 5,494,163 | A | 2/1996 | Apps |

(Continued)

FOREIGN PATENT DOCUMENTS

| | | |
|---|---|---|
| DE | 35 11 321 | 10/1986 |
| DE | 35 21 894 | 1/1987 |
| DE | 199 39 019 A1 | 2/2001 |
| DE | 200 02 537 UI | 7/2001 |
| EP | 0 311 174 A1 | 4/1989 |

(Continued)

*Primary Examiner*—Stephen Castellano

(57) ABSTRACT

A storage container has a floor and two pairs of opposed walls extending upwardly from the floor. Included is a bail member having bail ends mountable to one of the pairs of walls, and movable among nest and stack positions. Also included are mounting portions on one of the pairs of walls for receiving the bail ends. Mounting portions include an opening defining a plurality of pivot axes about which the bail member pivots, each axis oriented at substantially similar heights above the floor. When bail ends are positioned at one pivot axis, bail member is movable between the nested and a first stack positions. When bail ends are positioned at an other pivot axis, bail member is oriented in the second stack position. To move the bail member between first and second pivot axes, the bail member is raised upwardly within the opening and moved around an interference portion.

35 Claims, 17 Drawing Sheets

U.S. PATENT DOCUMENTS

| | | | |
|---|---|---|---|
| 5,609,254 | A | 3/1997 | Loftus et al. |
| 5,617,953 | A | 4/1997 | Cope |
| D381,203 | S | 7/1997 | Ackermann |
| D382,404 | S | 8/1997 | Cope |
| 5,752,602 | A | 5/1998 | Ackermann |
| 5,772,033 | A | 6/1998 | Loftus et al. |
| 5,881,902 | A | 3/1999 | Ackerman |
| 5,924,572 | A | 7/1999 | Cope |
| 6,059,114 | A | 5/2000 | Loftus |
| D436,729 | S | 1/2001 | Aiken |

FOREIGN PATENT DOCUMENTS

| | | |
|---|---|---|
| EP | 0 368 713 | 5/1990 |
| EP | 0 953 509 A1 | 3/1999 |
| FR | 2 678 585 | 1/1993 |
| GB | 2 124 588 | 2/1984 |
| GB | 2 129 401 | 5/1984 |
| GB | 2 137 167 | 10/1984 |
| GB | 2 141 778 | 1/1985 |
| GB | 2 171 980 | 9/1986 |
| GB | 2 180 821 | 4/1987 |
| GB | 2 209 737 | 5/1989 |
| NL | 790 5105 | 6/1979 |
| RU | 171783 | 3/1966 |
| TW | 338405 | 8/1998 |
| TW | 372539 | 10/1999 |
| WO | WO 98/01352 | 1/1998 |
| WO | WO 00/27716 | 5/2000 |
| WO | WO 00/66440 | 11/2002 |

PORTABLE STORAGE CONTAINER

BACKGROUND OF THE INVENTION

1. Field of the Invention

This invention relates to storage containers which are portable, and which are capable of stacking and nesting with similar containers.

2. Background Art

Portable storage containers which both stack and nest with similar containers are commonly used in industry for transporting and storing goods. Nesting is typically achieved when an empty container receives a like container therein such that there is some overlap between the walls and the containers. On the other hand, the stacking feature is typically used when an occupied container has a like container supported thereon, such that there is relatively little or no overlap between the walls of the containers, and the goods contained in the lower container are preferably not contacted or damaged by the upper container. Many containers use members known bail arms to achieve the stacking feature. Bail arms may typically be positioned out of the way for purposes of nesting, but then moved to a stacking position for allowing containers to be stacked thereon. Often, the stacks may consist of multiple containers having a load. Unfortunately, some containers may not have sufficient strength to accommodate such loads in a stack.

Further, some containers presently allow for only one stacking position. However, depending on the goods to be carried by the container, this single stacking position may not be efficient. Also, the mounting of many present bails may be inefficient, such that the bails of some containers may be required to travel a great distance in order to move the bail into various positions. This is often inefficient, from a design and a handling standpoint.

Accordingly, it is desired to have a portable container that is capable of nesting and stacking with similar containers, has the necessary strength to support the loads contained therein, particularly in a multiple stacked orientation. Further, it is desired to have a container which in its stacked position may accommodate various types and sizes of goods. The container should also have an efficiently means of mounting the bail arm, and for providing means for it to travel.

SUMMARY OF THE INVENTION

It is an object according to the present invention to provide a storage container having stacking features and capable of effectively supporting the load placed thereon.

It is also an object according to the present invention to provide a storage container which is stackable and nestable which is capable of accommodating in a stacked orientation goods of various sizes.

It is still another object according to the present invention to provide a container having a bail mounting, traveling, and pivoting portion having a space-efficient design.

In carrying out the above objects according to the present invention, provided is a portable storage container capable of supporting a second container in a plurality of positions relative to the container, the container having a floor member and an upstanding wall structure including a first pair of opposed walls and a second pair of opposed walls which are attached to each other. The walls extend upwardly from the floor member to define a unitary construction. The upstanding wall structure having a flange extending at least partially around an upper edge thereof. The container also includes a bail member having ends which are mountable to one of the first and second pairs of opposed side walls. The bail member is selectively movable and pivotable among a nest position and a plurality of stack positions. The container also includes mounting portions on the one of the first and second pairs of opposed side walls for receiving the ends of the bail member. The mounting portions including a non-linear opening defining a plurality of pivot axes about which the bail member pivots. Each pivot axis is oriented at a substantially similar height above the floor member.

When the bail member is oriented in the nest position and one of the stack positions, the bail member is pivotable about one of the pivot axes. When the bail member is oriented in an other of the stack positions, the bail member is pivotable about an other of the pivot axes. The mounting portion also includes a rigid projection extending into the radial opening such that the bail arm can not slide from the one pivot axis to the other pivot axis. The non-linear opening may have a radial shape, or a generally U-shape, or a generally J-shape. The wall structure may include an upper edge defining a recessed area in which the bail arm sits when oriented in one of the stack positions. Thus, the flange may have a predetermined height and include a reinforcement portion which extends below the recessed area for providing strength to the bail member in its stack positions. When the container is in a nesting position with a like container, the reinforcement portion rests in the recessed area of a subjacent container. The reinforcement portion has an upper surface defining the lower edge of the recessed area. The bail member includes a central portion which extends across the container compartment between the side walls, the bail member also having end portions, and further having intermediate portions which extend between the central portion and end portions.

Also provided in accordance with the teachings according to the present invention is a container having a floor member, and a first pair of opposed side walls and a second pair of opposed side walls which extend upwardly from the floor member to define a compartment capable of receiving a like container therein in a nested position. Further included is a bail member having ends mountable to one of the first and second pairs of opposed side walls, the bail member being selectively movable and pivotable among the nested position, a first stack position, and a second stack position. Also included are mounting portions on the one of the first and second pairs of opposed side walls for mountably receiving the ends of the bail member. The mounting portions include an opening which defines a first pivot axis and a second pivot axis which are oriented at a substantially similar height above the floor member and are separated by a rigid projection extending between the two pivot axes. When the bail member is oriented in the nested position and the first stack position, the bail member is pivotable about the first pivot axis, and when the bail member is oriented in the second stack position, the bail member is pivotable about the second pivot axis. To move the bail member from the first pivot axis to the second pivot axis, the bail member is raised up and around the rigid projection. The first pivot axis corresponds substantially with a first end of the opening, and the second pivot axis corresponds substantially with the second end of the opening.

Yet still in accordance with the present invention, also provided is a container having a floor member, and a first pair of opposed side walls and a second pair of opposed side walls which extend upwardly from the floor member to define a compartment capable of receiving a like container therein in a nested orientation. Also included is a bail member having a central portion extending across the compartment opening and oriented generally parallel to one of the first and second pairs of opposed side walls, the bail member further having ends mountable to the other of the first and second pairs of opposed side walls. The ends of the bail member are movable between a first pivot axis and a second pivot axis. Further included are mounting portions on the other of the first and second pairs of opposed side walls for receiving the ends of the bail member. The mounting portions include an opening having a first bail support portion defining the first pivot axis and a second bail support portion defining the second pivot axis and having a rigid projection extending between the first and second bail support portions. When the ends of the bail member are positioned at the first pivot axis, the bail member is pivotably movable between the nested position and a first stack position, and when the ends of the bail member are positioned at the second pivot axis, the bail member is orientable in the second stack position. To move the bail member from the first pivot axis to the second pivot axis, the bail member is raised upwardly within the opening to move around the rigid projection.

Yet still further provided in accordance with the present invention is a container having a floor member an upstanding wall structure extending upwardly from the floor member. The structure includes first and second pairs of opposed side walls integrally attached to each other and the floor member to define a unitary construction to define a compartment capable of receiving a like container therein in a nested orientation. Also included is a bail member having ends mountable to one of the first and second pairs of opposed side walls, the bail member selectively movable and pivotable among the nested position, a first stack position, and a second stack position. Further included are mounting portions on the one of the first and second pairs of opposed side walls for receiving the ends of the bail member. The mounting portions include an opening defining a first pivot axis and a second pivot axis separated by a rigid projection extending therebetween. When the bail member is oriented in the nested position and the first stack position, the bail member is pivotable about the first pivot axis, and when the bail member is oriented in the second stack position, the bail member is pivotable about the second pivot axis. When the bail member is oriented in the nested position and the first stacked position, the bail arm rests upon an inner wall member of one of the first pair of opposed sidewalls, and in the second stacked position, the bail arm rests upon an outer wall member of one of the second pair of opposed sidewalls which is offset outwardly from the inner wall member. When the bail member is in the nested position, it rests upon one of the second pair of opposed side walls. The outer wall member may be defined by the upper surface of a wall reinforcement portion extending below the mounting portions and which provide strength to the container when the bail is in the stacked positions.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
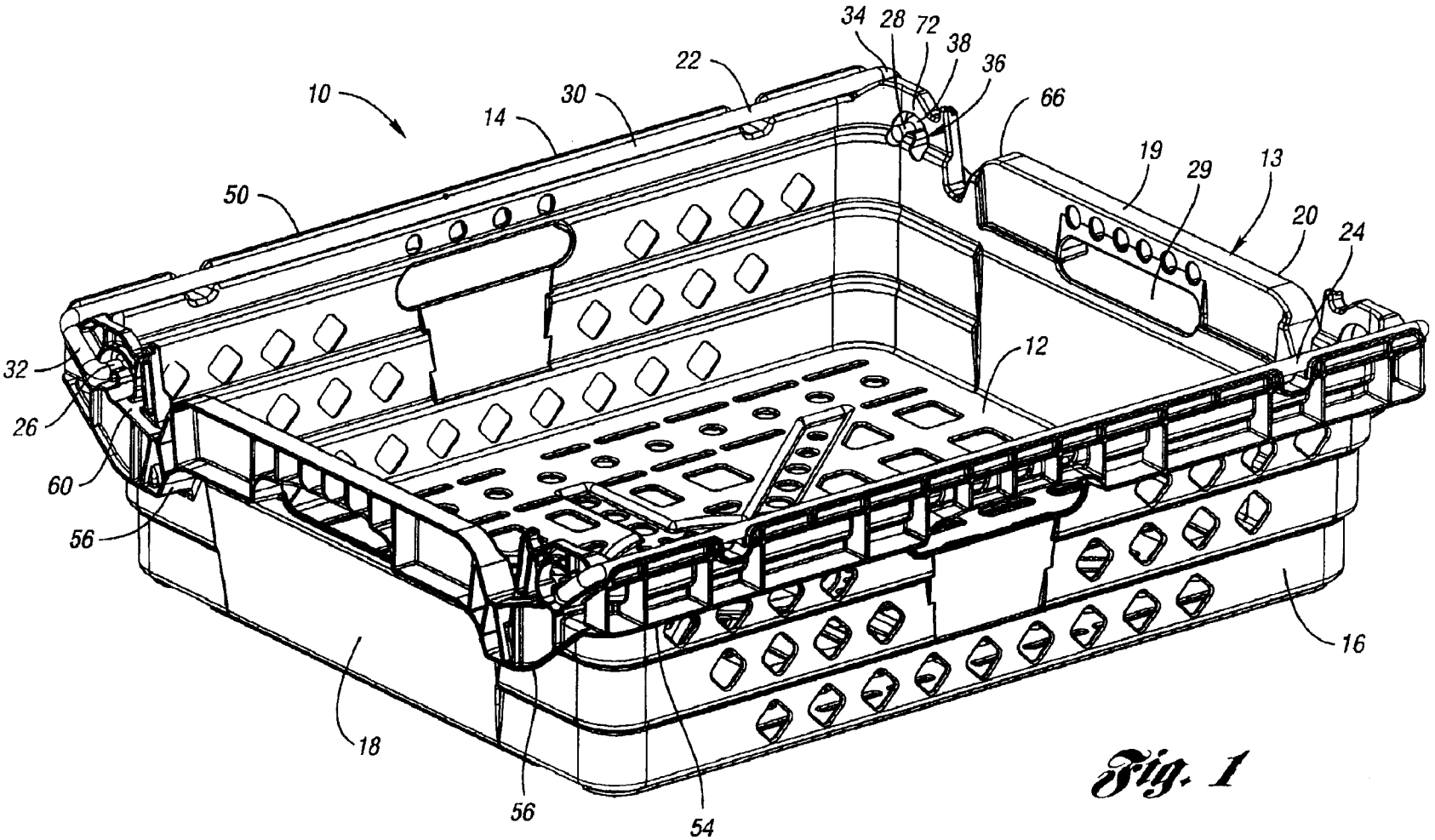
FIG. 1 illustrates a perspective view of a container according to the present invention, having a bail member in the nested position.

A container 10 according to the present invention is illustrated in FIGS. 1–11. Container 10 is preferably portable and includes a floor member 12 and an upstanding wall structure 13 extending upwardly from floor member 12. Upstanding wall structure 13 includes a first pair of upstanding opposed side walls 14, 16 and a second pair of upstanding opposed side walls 18,20 (also referred to as end walls.) Floor member 12 and walls 14–20 are integrally molded to form a unitary construction having a compartment area 21 within which goods are stored and transported. Container 10 preferably is formed from injection molded thermoplastic such as polyethylene. Container 10 also includes a pair of opposed support members 22,24 (also known in the art as bail arms or bail members), each of which is selectively moveable and pivotable among a plurality of positions, with at least three such positions illustrated herein.

Figure 10A:
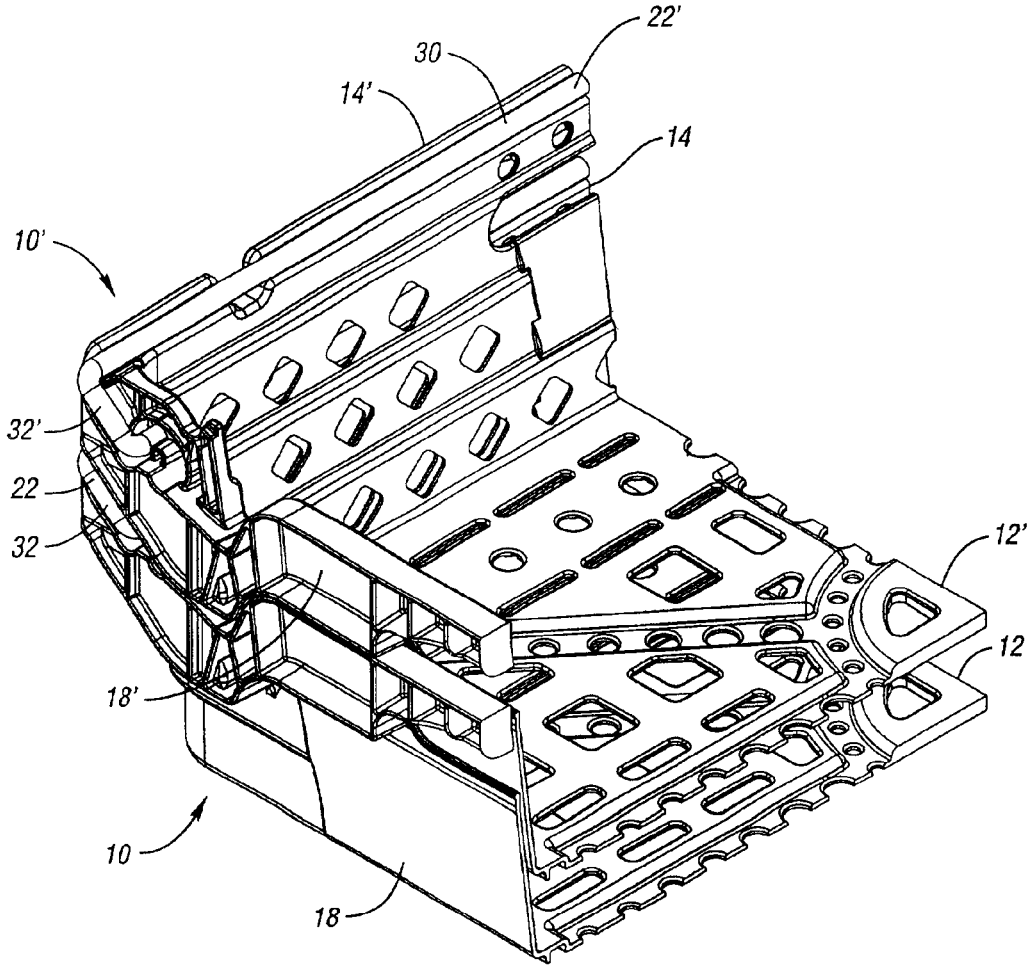
FIG. 10*a* illustrates a partial perspective view of a pair of containers nested together.

For ease of discussion, reference will be made to bail arm 22, it being understood that opposed bail arm 24 is operable in a similar manner. Bail arm 22 includes a first outer end 26 and a second outer end 28, each outer end 26,28 engaged with and being mountably connected to a respective end wall 18,20. Bail arm 22 includes an elongated central bail portion 30 extending across the compartment area 21 between side walls 14,16. Bail arm 22 also includes intermediate bail portions 32,34 extending between the central portion 30 and the end portions 26,28. Bail arms 22,24 are positionable at a nest position such that a like container may nest fully therein, useful for when container 10 is empty to achieve space efficiency in storage and transport, as shown in FIGS. 1 and 10*a*. As shown in FIGS. 2–3 and 10*a*–10*b*, when in the stack positions, bail arms 22,24 are operable to support a like container 10' among a plurality of stack positions to achieve multi-height stacking capability and defining various stack heights between the like containers. More particularly, the like container 10' is supported upon bail central portion 30 which extends across the length of container 10 and is oriented generally parallel to side walls 14,16.

As illustrated in FIGS. 1–4*b* and 6–7, each end wall 18,20 includes a mounting portion 36 for receiving and for mounting bail arms 22,24 thereon. Specifically, mounting portion 36 includes an opening 38 for receiving outer bail ends 26,28 therein. Particularly, bail ends 26,28 are bended inward and received within opening 38. The opening 38 provides or defines a path, which in the embodiment illustrated is generally radial, and through which the bail arm 22 may rotatably and transversely move. However, it is understood that opening 38 need not have a radial curvature to achieve the teachings according to the present invention. As illustrated in FIGS. 4*a*–4*b* and 6–7, opening 38 defines a plurality of pivot axes 40,42 about which bail arm 22 pivots, each pivot axis 40,42 being oriented adjacent to each other and oriented at a substantially similar height above the floor member 12, so that bail arm 22 achieves one or more of the corresponding nest and stack heights.

More particularly, each opening 38 defines a generally inverted U-shaped or J-shaped channel, wherein the each pivot axis 40,42 is located at a corresponding end of the channel, such that each end of the channel (like pivot axis 40,42) is of approximately similar height above floor member 12. Mounting portions 36 also include a interference portion, comprising a rigid projection 44 extending into the opening 38, projection 44 for impeding lateral movement of bail arm 22 such that bail arm 22 can not slide or move laterally from one pivot axis to the other. Projection 44 is preferably rigid and inflexible.

Figure 2:
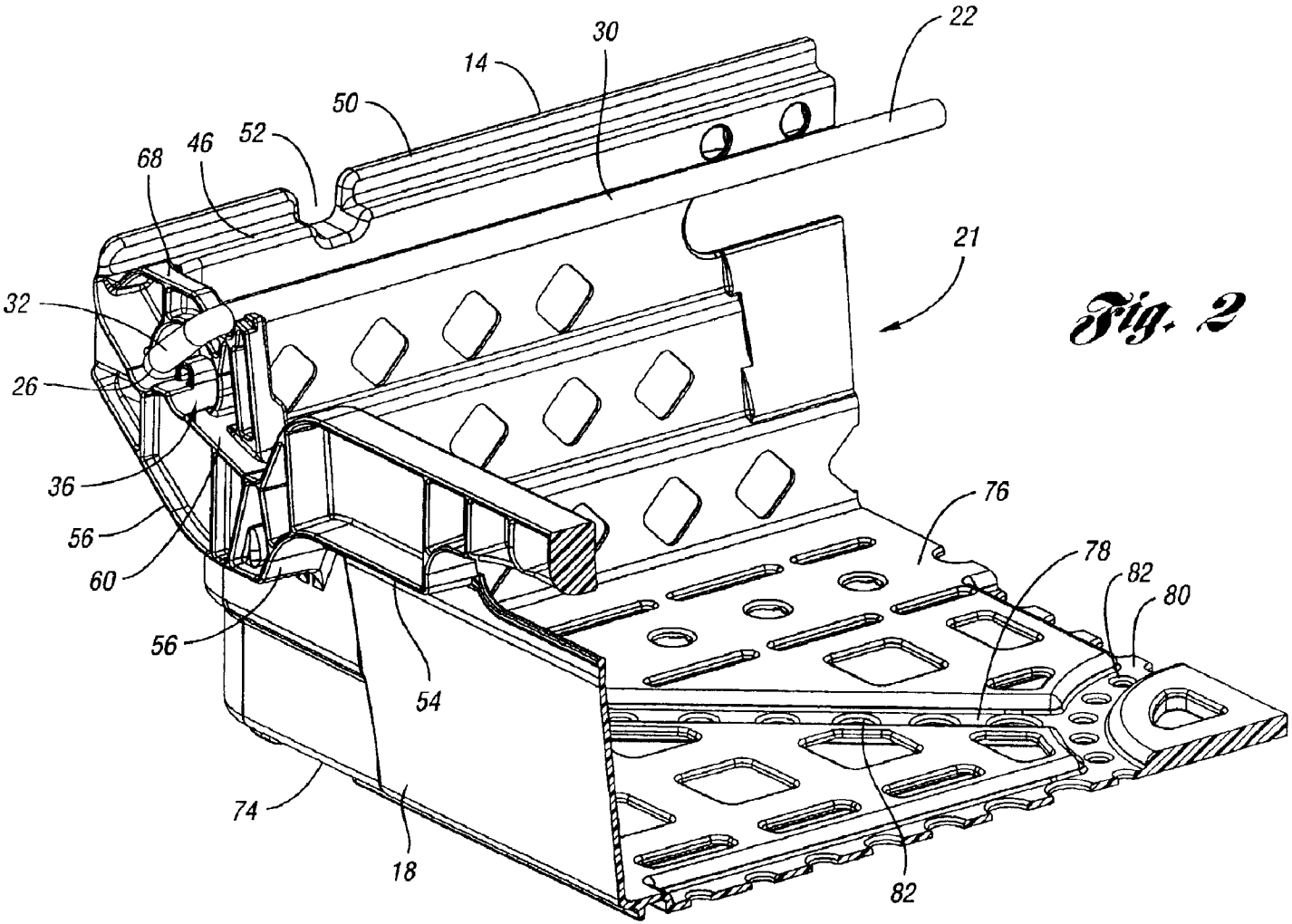
FIG. 2 illustrates a perspective view of a container according to the present invention, having the bail member oriented in a first high stack position.
Figure 3:
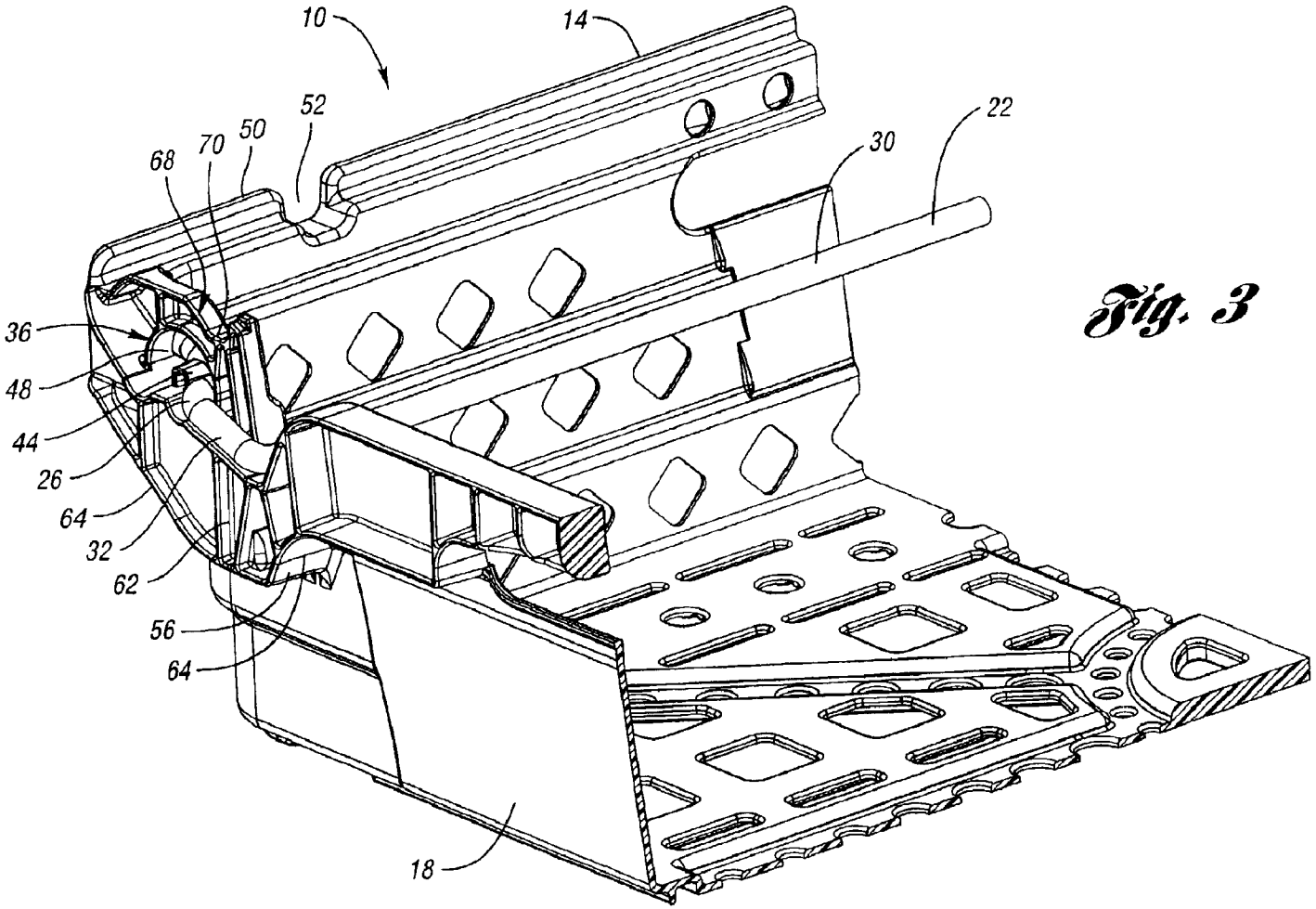
FIG. 3 illustrates a perspective view of a container according to the present invention, having the bail member oriented in a second low stack position.
Figure 4A:
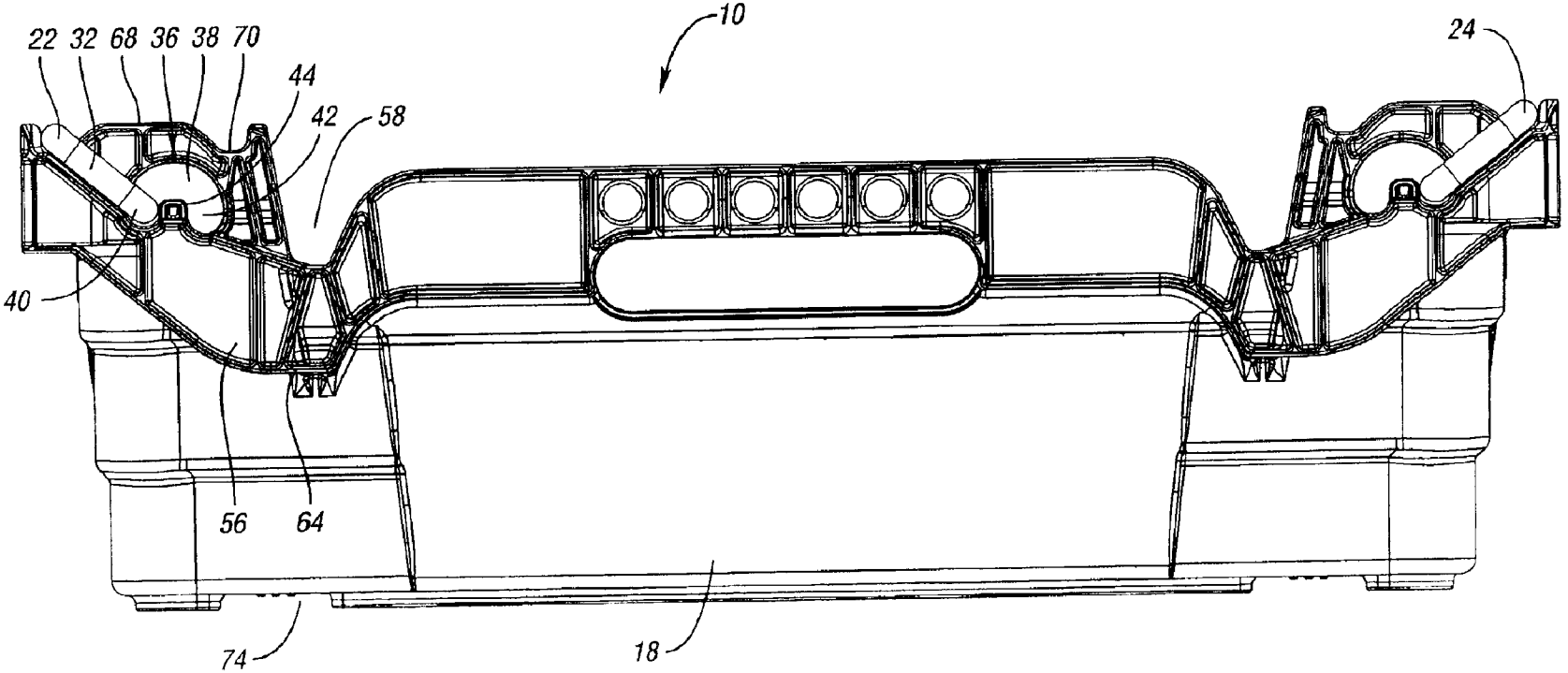
FIG. 4*a* illustrates an end view of the container with the bail member oriented in the nested position, the rear view being a mirror image thereof.
Figure 4B:
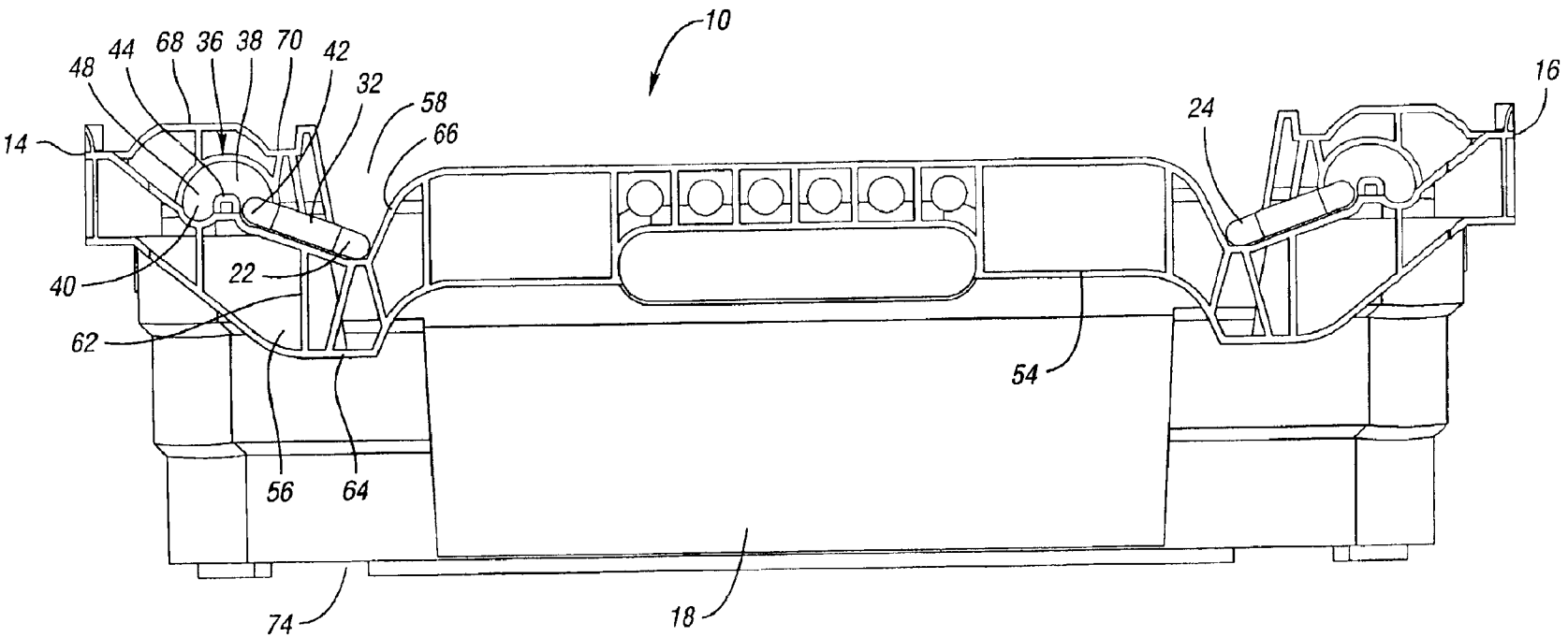
FIG. 4*b* illustrates an end view of the container with the bail member oriented in the second low stack position, the rear view being a mirror image thereof.
Figure 6:
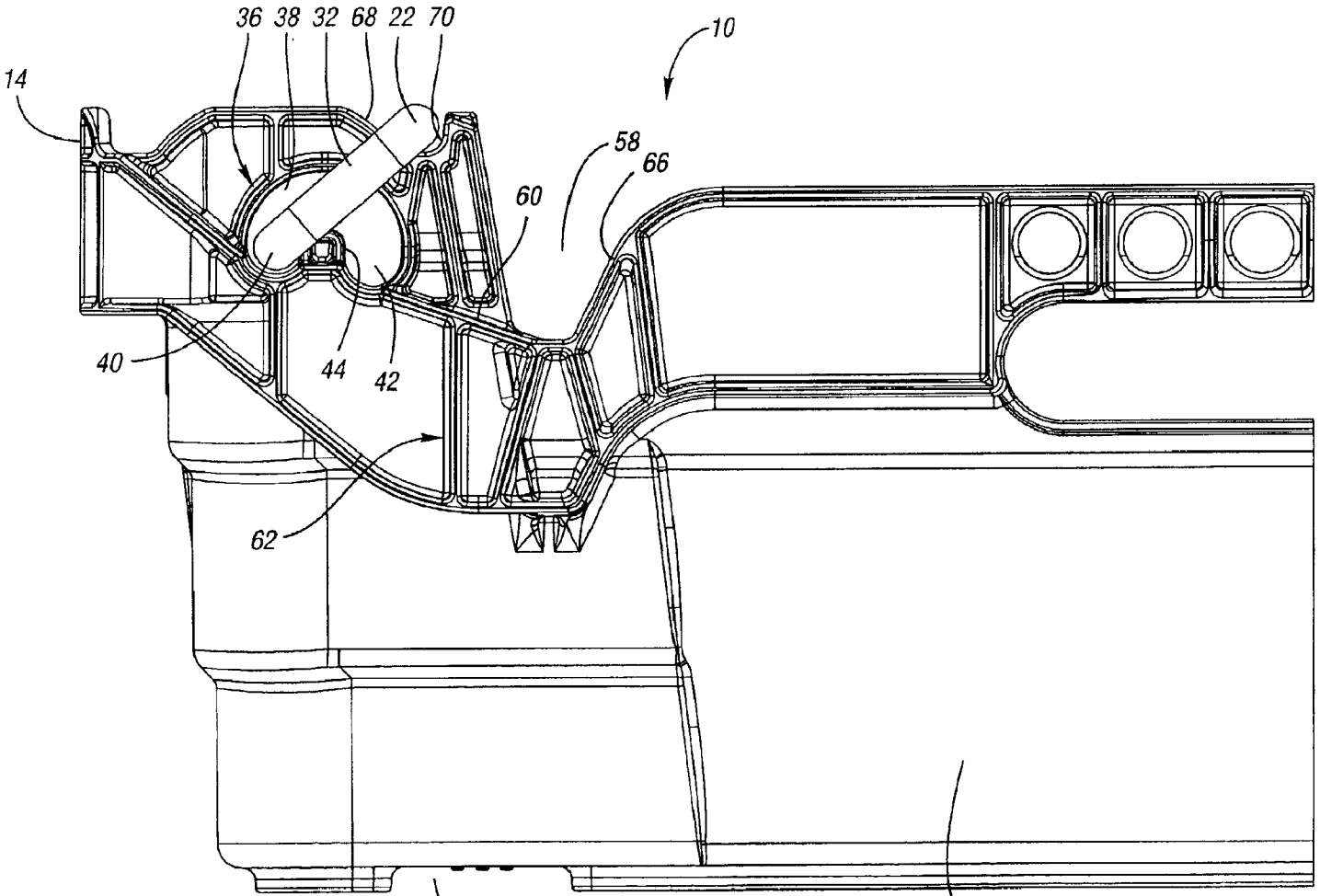
FIG. 6 illustrates a partial end view of the container, having the bail member in the first high stack position.
Figure 7:
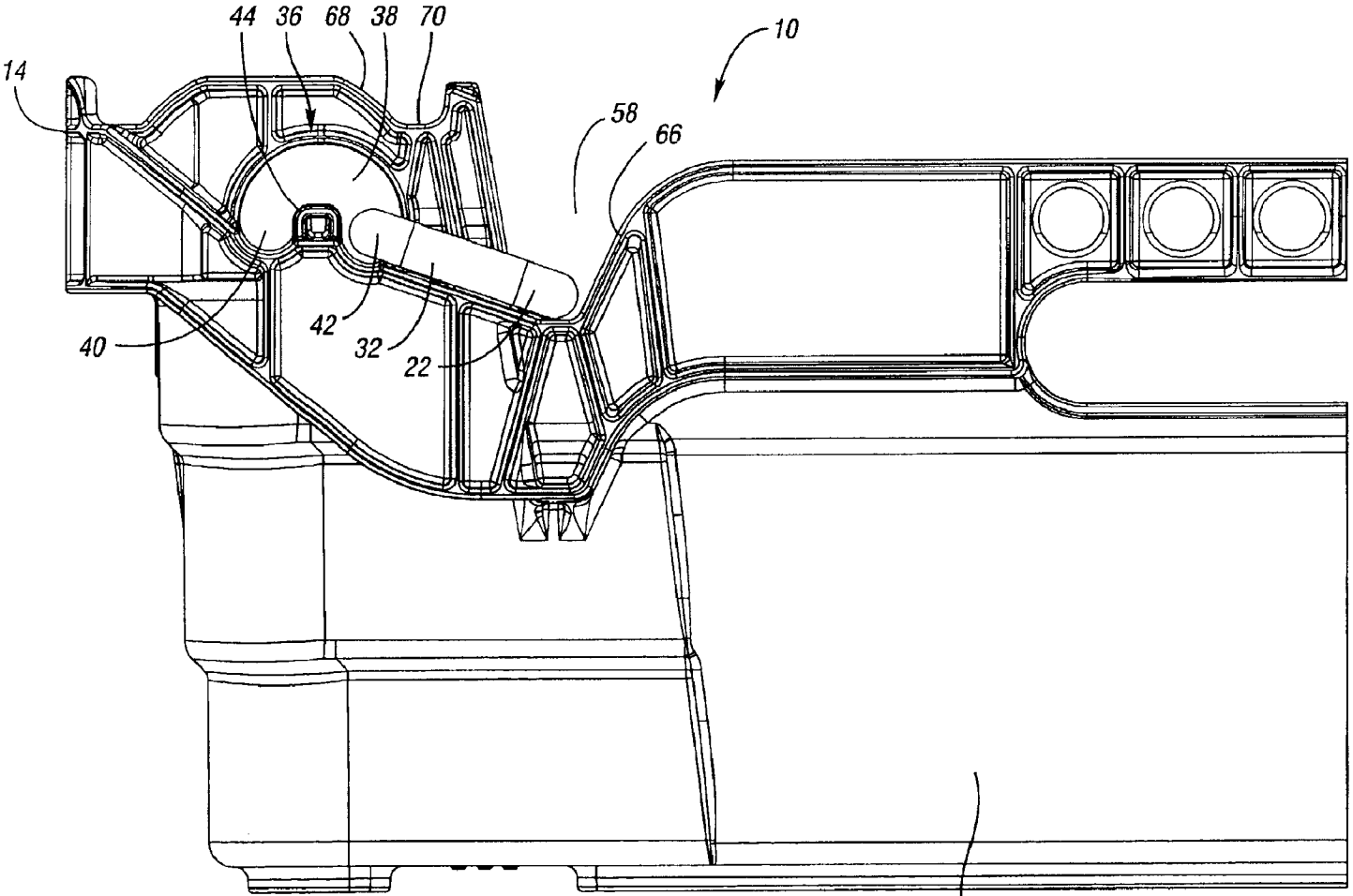
FIG. 7 illustrates a partial side view of the container, having the bail member in the second low stack position.
Figure 10B:
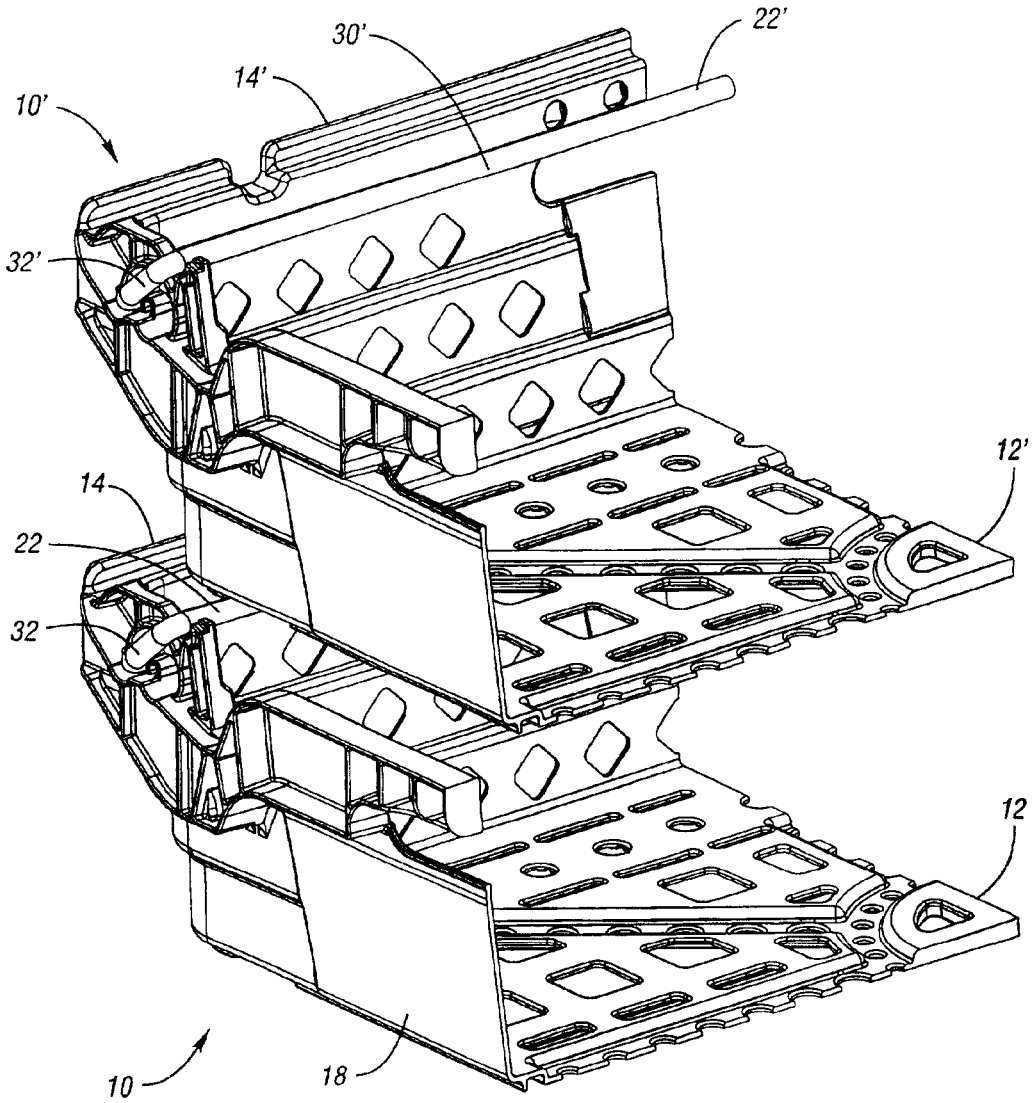
FIG. 10*b* illustrates a partial perspective view of the container stacked on top of a like container in the first high stack position.
Figure 10C:
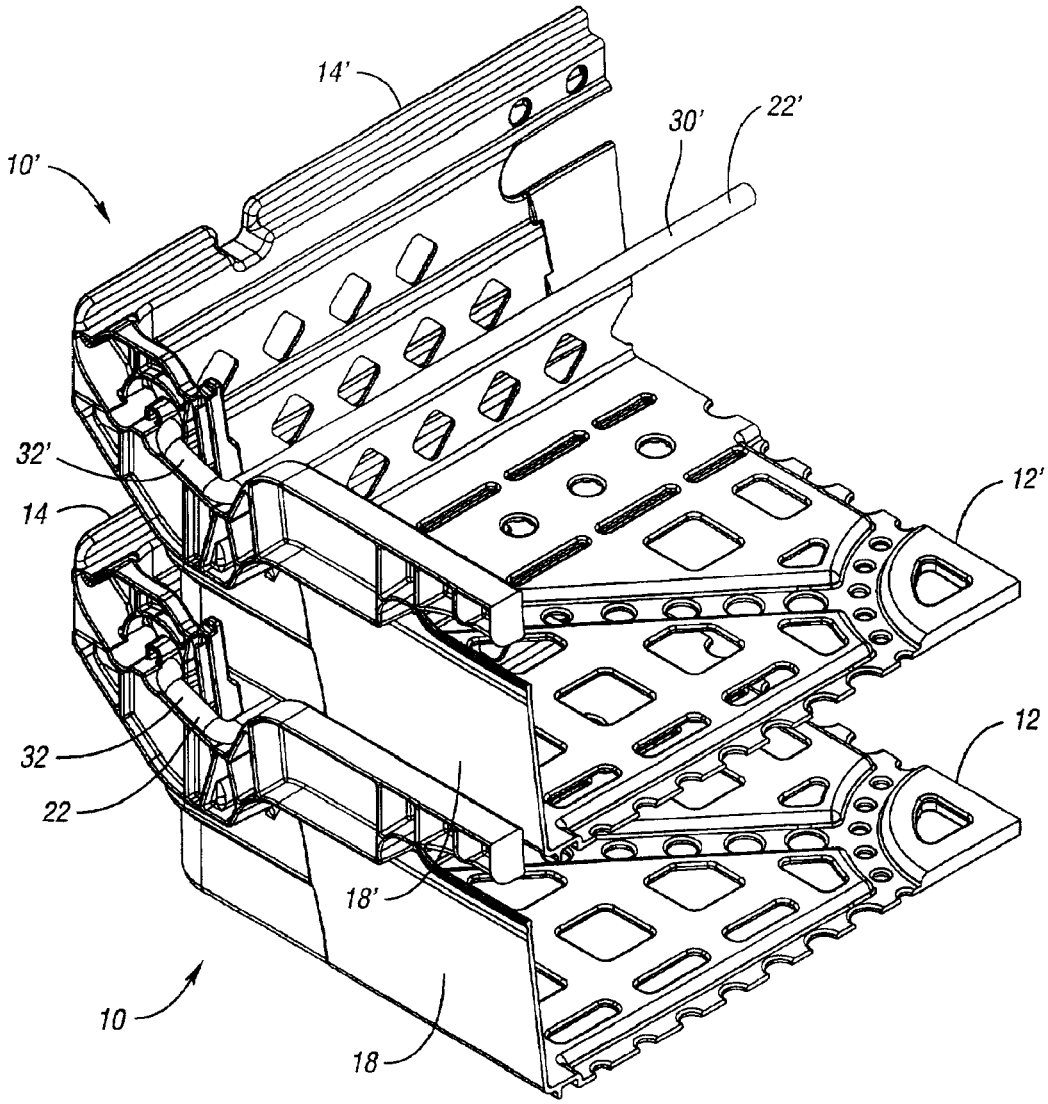
FIG. 10*c* illustrates a partial perspective view of the container stacked on top of a like container in the second low stack position.
Figure 11:
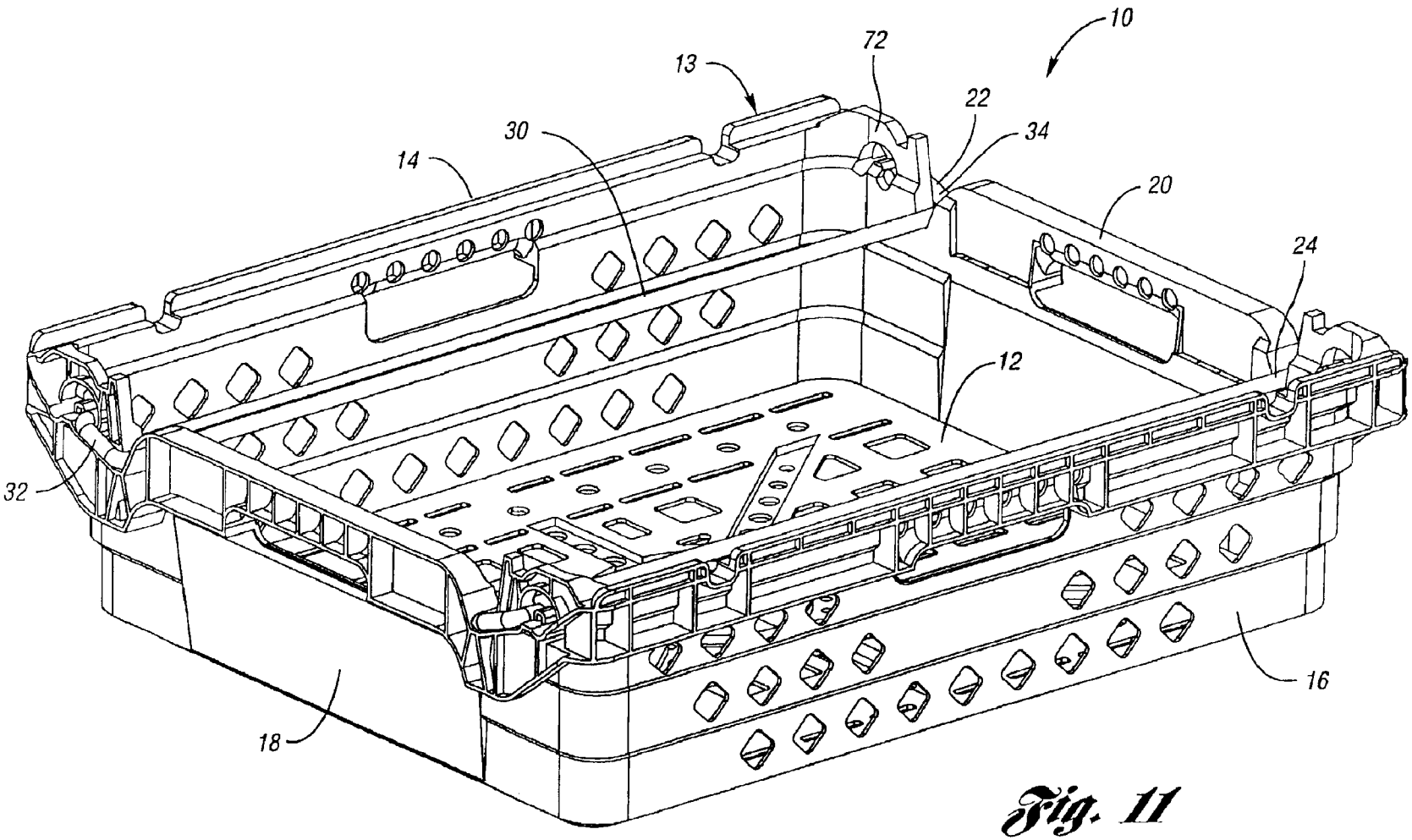
FIG. 11 illustrates a perspective view of the container with the bail member in the second low stack position.

As noted, bail arm 22 is movable and pivotable among a plurality of positions, including a nest position (FIGS. 1 and 10*a*) and a plurality of stack positions (FIGS. 2–3 and 10*b*–10*c*), such as a first stack (or high stack) position of FIGS. 2, 6 and 10*b*, and a second stack (or low stack) position of FIGS. 3, 7, and 10*c*. Thus, when bail arm 22 is oriented in the nest position and one of the stack positions, such as the high stack position shown in FIG. 2, the bail arm 22 is pivotable about a first one of the pivot axes, such as axis 40, and movable between the nest position and the high stack position. Further, when the bail arm 22 is oriented in an other of the stack positions, such as the low stack position shown in FIG. 3, the bail arm 22 is pivotable about an other of the pivot axes, such as pivot axis 42.

Figure 5A:
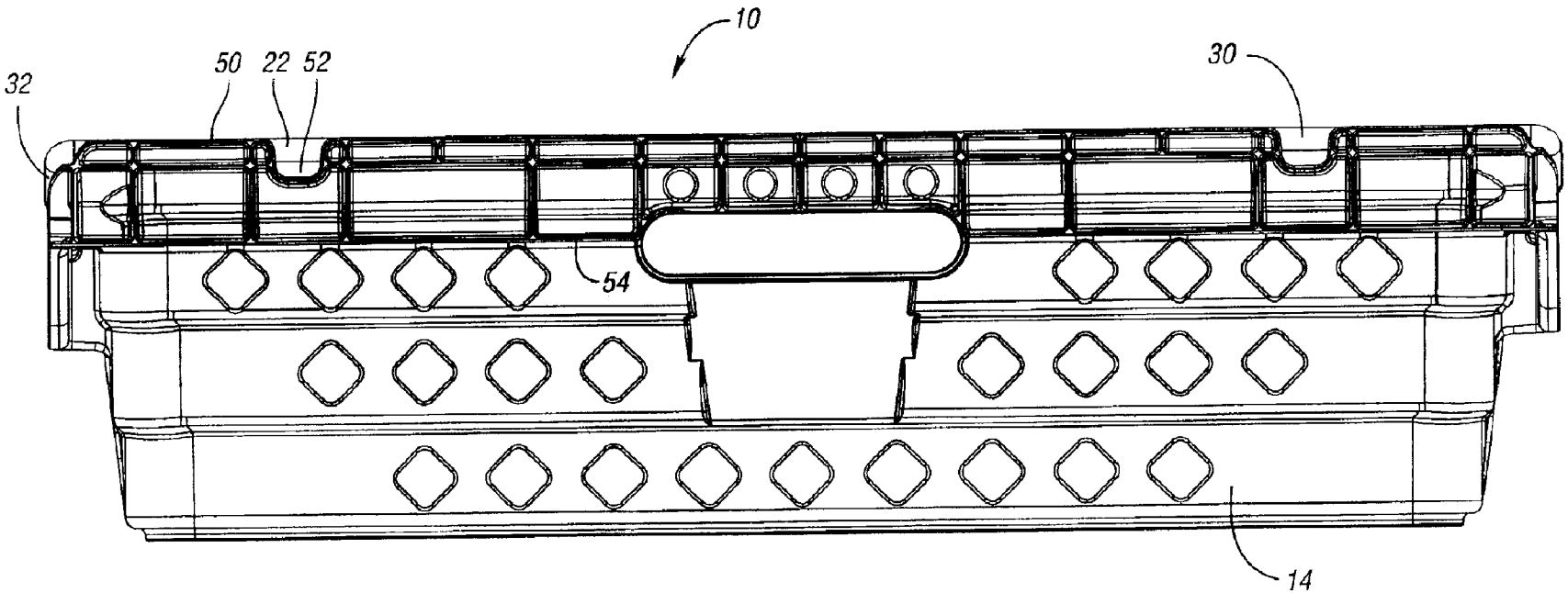
FIG. 5*a* illustrates a side view of the container, having the bail member in the nested position.
Figure 5B:
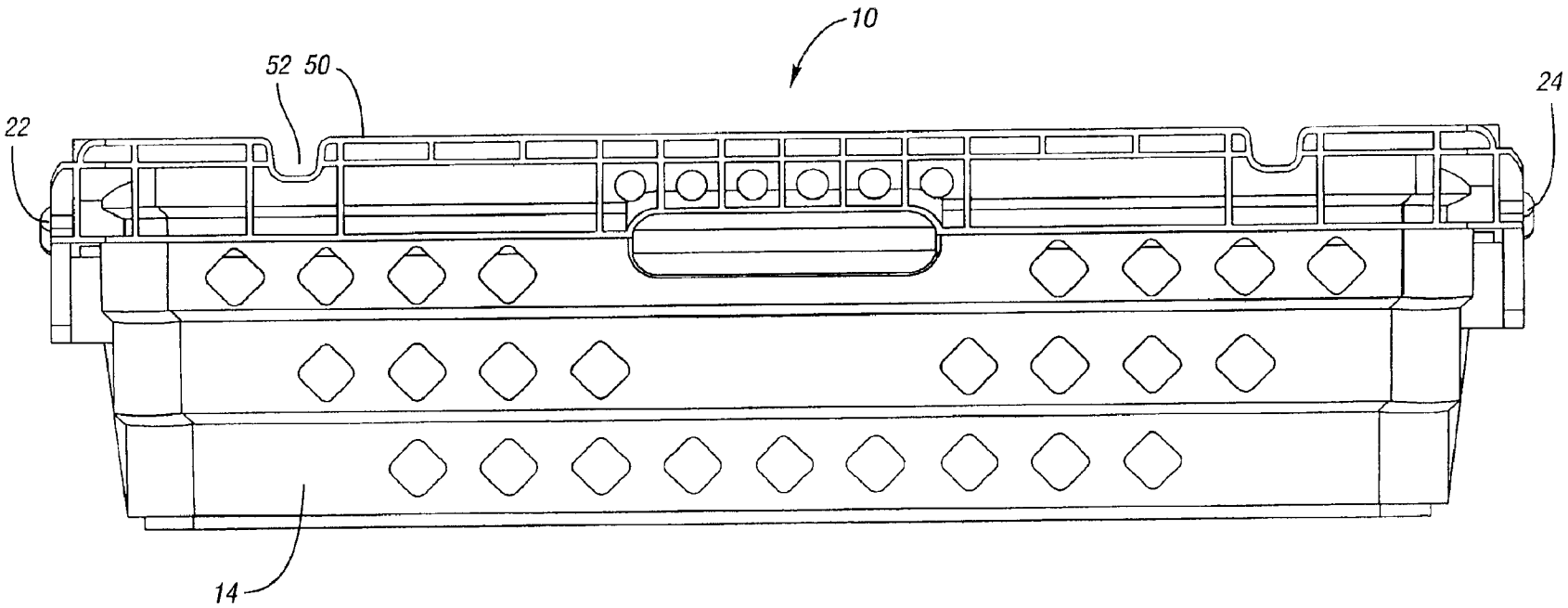
FIG. 5*b* illustrates a side view of the container, having the bail member in the second low stack position.
Figure 8A:
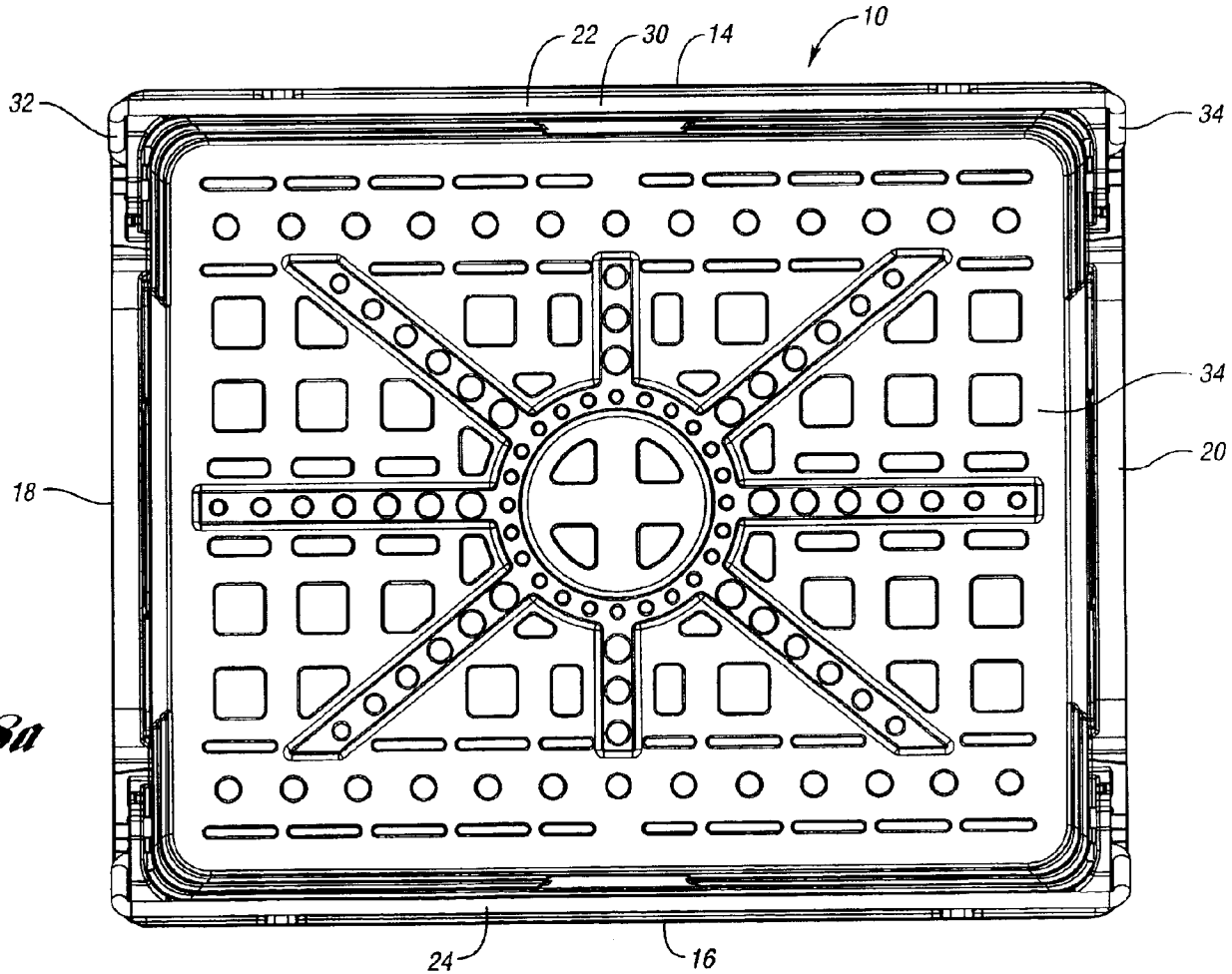
FIG. 8*a* illustrates a top view of the container with the bail member in the nested position.
Figure 8B:
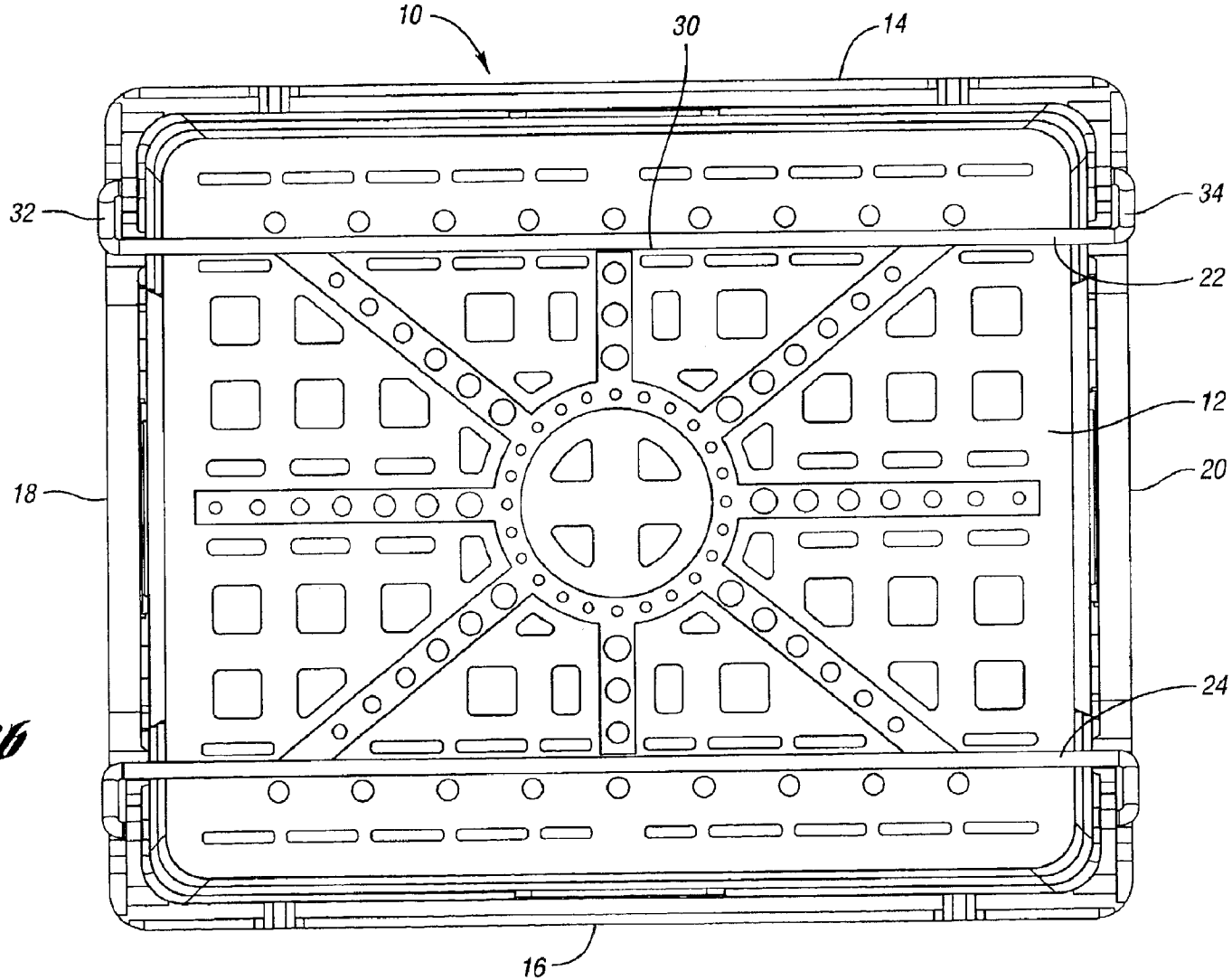
FIG. 8*b* illustrates a top view of the container with the bail member in the second low stack position.
Figure 9A:
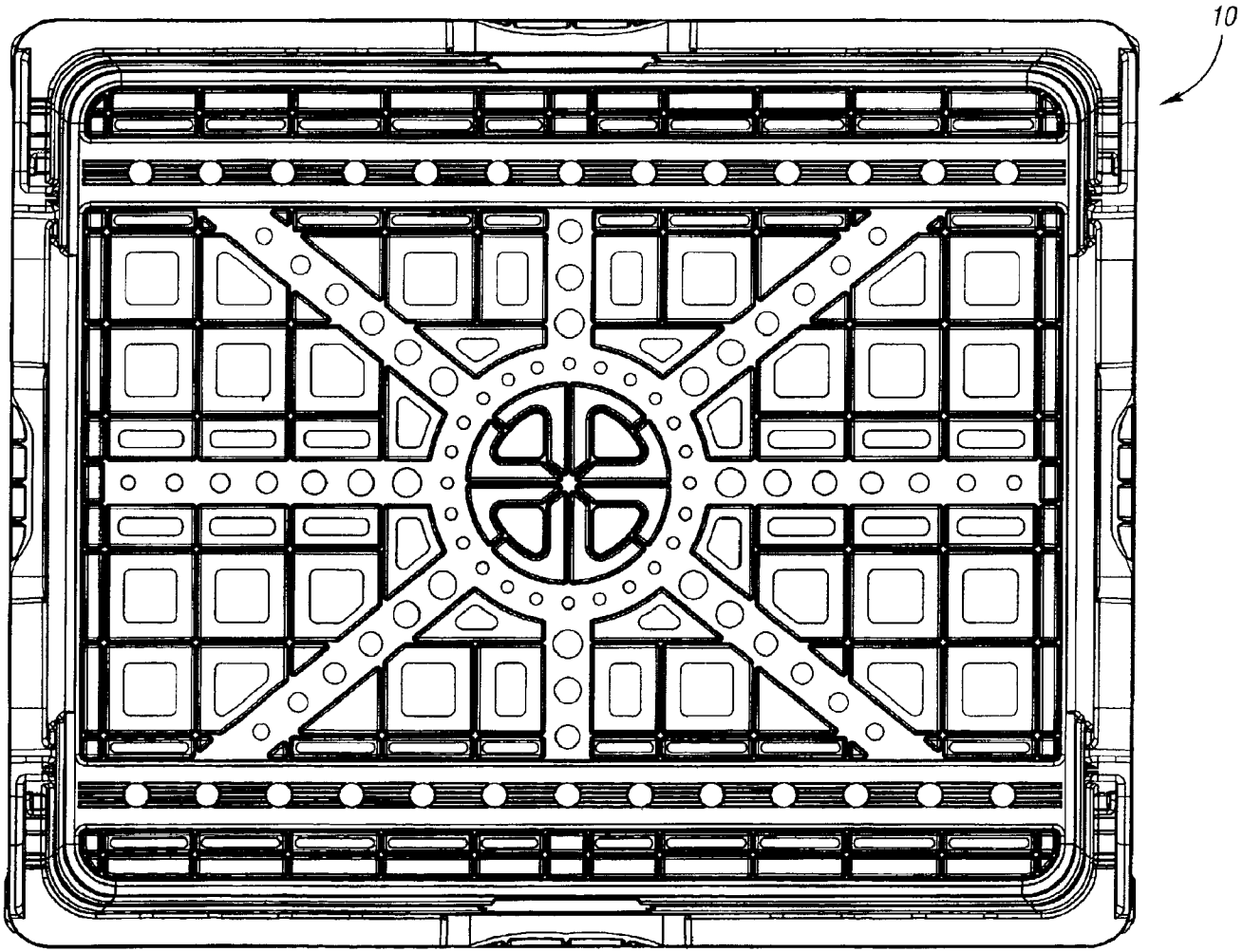
FIG. 9*a* illustrates a bottom view of the container.
Figure 9B:
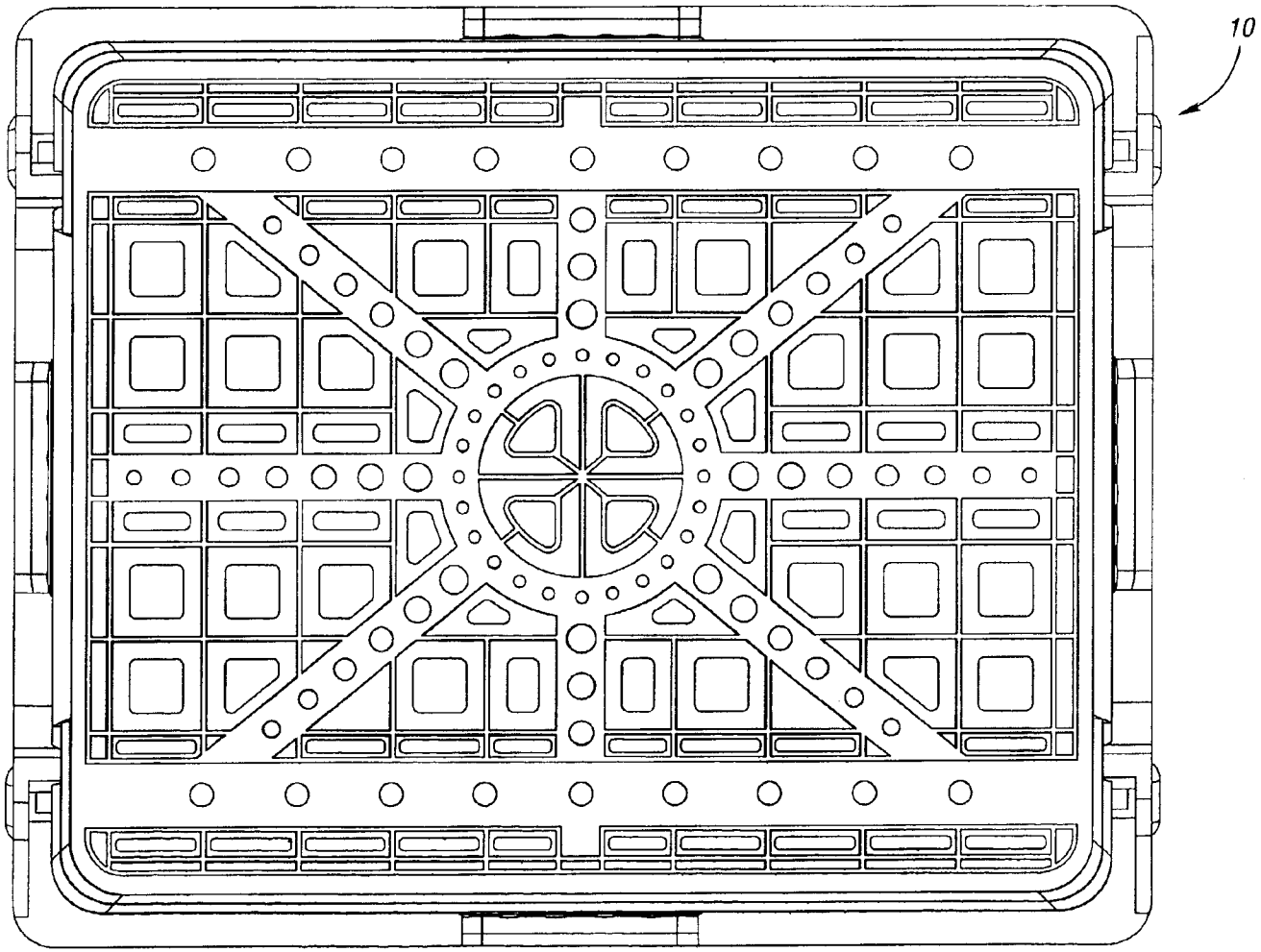
FIG. 9*b* illustrates an alternate bottom view of the container.

FIGS. 1, 5*a*, and 8*a* illustrate bail arm 22 in the outwardly rotated or nestable position. In this orientation, bail arm 22 is supported upon an outer, upper surface 46 of side wall 14 such that access to the compartment area 21 is unrestricted and thus may receive a like container therein in a nest position. In this position, bail outer ends 26, 28 are disposed in the outer portion 48 of opening 38 and pivotable about pivot axis 40. The bail arm 22 is prevented from moving laterally into pivot axis 42 by the extension of projection 44 into opening 38. Upper surface 46 and its corresponding upper side edge 50 include notches 52 that provide access to bail member 22 and that allow for manipulation of bail member 22 from outside container 10.

As shown in FIGS. 6–7, wall structure 13 of container 10 also includes a flanged upper rim 54 of container 10, the flanged upper rim 54 having a predetermined height. Below mounting area 36, flanged rim 54 includes a reinforcement portion 56 extending below the mounting area 36 and a recessed area 58 for providing strength to the bail members 22,24 in their stack positions. End walls 18,20 include at their outer ends recessed area 50 formed in the upper edge of container 10, within which the bail arm 22 rests and is supported when in its second (low) stack position, as in FIGS. 3 and 7. In this second stack position, the intermediate portions 32,34 of bail arm 22 rests upon reinforcement area upper surface 60, which is offset outwardly from the inboard wall portion 68 and mounting portion 36. The flanged area along the end walls 18, 20 define a handle bar 19 by which the container 10 is portable and thus may be manipulated. An opening 29 is disposed below handle bar 19 for providing hand clearance.

The upper surface 60 of the reinforcement portion 56 defines the lower edge of the recessed area 58. Surface 60 is inclined and angled to support the intermediate bail portions 32,34 when in the second (low) stack position (FIG. 3). Reinforcement portion 56 extends below the mounting portion 36, and particularly below the pivot axes 40,42 for providing support and strength to bail member 22 when in its stack positions (FIGS. 2–3). Reinforcement portion 56 is shown having a ribbed structure 62 and an outer contoured surface 64 generally matching that of the surface 66 which defines recessed area 58. When in the nested position with a like container 10' as in FIG. 10*a*, reinforcement portion 56 of an upper container 10' nests comfortably in a correspondingly shaped recessed area 58 of a lower container 10.

Proximate mounting portions 36, end walls 18,20 of container 10 include at their outer ends an inboard side wall portion 68, which is offset inwardly from the outer surface of the flange 54, and is oriented generally parallel thereto. When the bail member 22 is oriented in the first (high) stack position of FIGS. 2 and 6, the bail arm 22 rests and is supported in an upper recess 70 formed in inboard side wall portion 68. The inner surface 72 of side wall portion 68 partially defines the interior surface of the container. It is noted that opening 38 is not located directly below recess 58, but instead is offset therefrom. Thus, when the bail arm 22 is supported in recess 58 and other containers are stacked thereon as in FIG. 10*c*, the load is supported directly thereunder by wall material providing strength thereto, and not by a portion lacking some wall material (i.e. opening 38.)

Accordingly, to move the bail member 22 from the first pivot axis 40 to the second pivot axis 42, the bail member 22 is grasped by a user, such that the bail arm ends 26,28 may be moved upwards within opening 38 and moved around the rigid projection 44. Thus, bail arm 22 may be manipulated so that it maybe oriented in one of the various positions. Since pivot axes 40 and 42 are adjacent and separated by projection 44, bail arm 22 is not required to travel a great distance to move between the pivot axes. In other words, the present invention provides a compact, highly efficient bail mounting area of optimal size and position for the container, wherein the pivot axes 40,42 are effectively directly adjacent to each other, but the bail is not capable of moving directly axially or laterally between the pivot axes due to the intervening projection 44. When in the stack positions, the bail member 22 is received within a corresponding grooved recess 74 formed in the bottom surface of floor member 12, for restricting the relative movement of the upper container 10' to the lower container 10 when in a stack position.

As best illustrated in FIG. 2, floor 12 has an upper surface 76 with a plurality of recessed channels 78 formed therein which are radially extending from a central recessed area 80. Channels 78 serve to directed liquid away from the contents of the container, and the holes provided 82 in floor 12 (some located within the channels 78) serve as an exit for the liquid.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A container capable of supporting a second container in a plurality of positions relative to the container, the container comprising:

a floor member;

an upstanding wall structure including a first pair of opposed walls and a second pair of opposed walls attached to each other and extending upwardly from the floor member to define a unitary construction, the upstanding wall structure having a flange extending at least partially around an upper edge thereof;

a bail member having ends mountable to one of the first and second pairs of opposed side walls, the bail member selectively movable and pivotable among a nest position and a plurality of stack positions, wherein a support portion of the bail member is not positioned directly over the floor member in the nest position and is positioned directly over the floor member in the plurality of stack positions; and mounting portions on the one of the first and second pairs of opposed side walls for receiving the ends of the bail member, the mounting portions including a non-linear opening defining a plurality of pivot axes about which the bail member pivots, wherein when the bail member is oriented in the nest position and one of the stack positions, the bail member is pivotable about one of the pivot axes, and when the bail member is oriented in an other of the stack positions, the bail member is pivotable about an other of the pivot axes, the mounting portion also including a rigid projection extending upwardly into the non-linear opening such that the bail member can not slide from the one pivot axis to the other pivot axis, the other pivot axis at a height above the floor member not greater than that of the one pivot axis, wherein the support portion of the bail member is a first distance from the floor member when the bail member is in the one stack position, the one pivot axis a second distance from the floor member, the first distance not less than the second distance.

2. The container of claim 1, wherein the non-linear opening has a radial shape.

3. The container of claim 1, wherein the non-linear opening has a generally U-shape.

4. The container of claim 1, wherein the non-linear opening has a generally J-shape.

5. The container of claim 1, wherein the wall structure includes an upper edge defining a recessed area in which the bail member sits when oriented in one of the stack positions.

6. The container of claim 5, wherein the flange has a predetermined height and includes a reinforcement portion extending below the recessed area for providing strength to the bail member in its stack positions, wherein when the container is in a nesting position with a like container, the reinforcement portion rests in the recessed area of a subjacent container.

7. The container of claim 6, wherein the reinforcement portion has an upper surface defining the lower edge of the recessed area.

8. The container of claim 1, wherein the bail member includes a central portion extending across the container compartment between the side walls, end portions, and intermediate portion extending between the central portion and end portions.

9. A container comprising:

a floor member;

a first pair of opposed side walls and a second pair of opposed side walls extending upwardly from the floor member to define a compartment capable of receiving a like container therein in a nested position;

a bail member having ends mountable to one of the first and second pairs of opposed side walls, the bail member selectively movable and pivotable among the nested position, a first stack position, and a second stack position, wherein a support portion of the bail member is not positioned directly over the floor member in the nest position and is positioned directly over the floor member in the first stack position and the second stack position; and mounting portions on the one of the first and second pairs of opposed sidewalls for mountably receiving the ends of the bail member, the mounting portions including an opening defining a first pivot axis and a second pivot axis separated by a rigid projection extending upwardly therebetween, wherein when the bail member is oriented in the nested position and the first stack position, the bail member is pivotable about the first pivot axis, and when the bail member is oriented in the second stack position, the bail member is pivotable about the second pivot axis, such that to move the bail member from the first pivot axis to the second pivot axis, the bail member is raised up and around the rigid projection, the second pivot axis at a height above the floor not greater than that of the first pivot axis, wherein the support portion of the bail member is a first distance from the floor member when the bail member is in the first stack position, the first distance not less than the height of the first pivot axis.

10. The container of claim 9, wherein the first pivot axis corresponds substantially with a first end or the opening.

11. The container of claim 9, wherein the second pivot axis corresponds substantially with the second end of the opening.

12. The container of claim 9, wherein when in the second stack position, the bail member rests in a recessed area formed in the upper surface of the container, the container further comprising a reinforcement portion extending below the recessed area for providing strength to the bail member in the first and second stack positions.

13. The container of claim 12, wherein when the container is in a nested position with a like container, the reinforcement portion rests in the recessed area of a subjacent container.

14. The container of claim 12, wherein the reinforcement portion has an upper surface defining the lower edge of the recessed area.

15. A container comprising:

a floor member;

a first pair of opposed side walls and a second pair of opposed side walls extending upwardly from the floor member to define a compartment capable of receiving a like container therein in a nested orientation;

a bail member having a central portion extending across the compartment opening and oriented generally parallel to one of the first and second pairs of opposed side walls, and further having ends mountable to the other of the first and second pairs of opposed side walls, the ends of the bail member movable between a first pivot axis and a second pivot axis; and mounting portions on the other of the first and second pairs of opposed side walls for receiving the ends of the bail member, the mounting portions including an opening having a first bail support portion defining the first pivot axis and a second bail support portion defining the second pivot axis and having an interference portion extending upwardly between the first and second bail support portions, wherein when the ends of the bail member are positioned at the first pivot axis, the bail member is pivotably movable between the nested position and a first stack position, and when the ends of the bail member are positioned at the second pivot axis, the bail member is orientable in a second stack position, wherein to move the bail member from the first pivot axis to the second pivot axis, the ball member is raised upwardly within the opening to move around the interference portion, wherein the central portion of the bail member is not positioned directly over the floor member in the nested position and is positioned directly over the floor member in the first stack position and the second stack position, wherein the central portion of the bail member is a first distance from the floor member when the bail member is in the first stack position, the first pivot axis a second distance from the floor member, the first distance not less than the second distance.

16. The container of claim 15, wherein the first and second pivot axes are oriented at a substantially similar height above the floor member.

17. The container of claim 15, wherein the interference portion is a rigid projection extending into the opening.

18. The container of claim 15, wherein the opening has a generally U-shape.

19. The container of claim 15, wherein the opening has a generally J-shape.

20. The container of claim 15, wherein when in the second stack position, the bail member rests in a recessed area formed in the upper surface of the container, the container further comprising a reinforcement portion extending below the recessed area far providing strength to the bail member in the first and second stack positions.

21. The container of claim 20, wherein when the container is in a rested position with a like container, the reinforcement portion rests in the recessed area of a subjacent container.

22. The container of claim 20, wherein the reinforcement portion has an upper surface defining the lower edge of the recessed area.

23. A container comprising:

a floor member;

an upstanding wall structure extending upwardly from the floor member and having first pair of opposed side walls and a second pair of opposed side walls integrally attached to each other and the floor member to define a unitary construction to define a compartment capable of receiving a like container therein in a nested orientation;

a bail member having ends mountable to one of the first and second pairs of opposed side walls, the bail member selectively movable and pivotable among the nested position, a first stack position, and a second stack position, wherein a central portion of the bail member extends across an opening of the compartment and is positioned directly over the floor member in the first stack position and the second stack position, the central portion not positioned directly over the floor member in the nest position, and mounting portions on the one of the first and second pairs of opposed side walls for receiving the ends of the bail member, the mounting portions including an opening defining a first pivot axis and a second pivot axis, wherein when the bail member is oriented in the nested position and the first stack position, the bail member is pivotable about the first pivot axis, and when the bail member is oriented in the second stack position, the bail member is pivotable about the second pivot axis, wherein when the bail member is oriented in the nested position and the first stacked position, the bail member rests upon an inner wall member of the one of the first and second pairs of opposed sidewalls, and in the second stacked position, the bail member rests upon an outer wall member of the one of the first and the second pairs of opposed sidewalls, the outer wall member offset outwardly from the inner wail member.

24. The container of claim 23, wherein the first and second pivot axes are oriented at a substantially similar height above the floor member.

25. The container of claim 23, wherein when the bail member is in the nested position, it rests upon one of the second pair of opposed side walls.

26. The container of claim 23, wherein the outer wall member is defined by the upper surface of a wall reinforcement portion extending below the mounting portions for providing strength to the container when the bail is in the stacked positions.

27. A container capable of supporting a second container in a plurality of positions relative to the container, the container comprising:

a floor;

an upstanding wall structure including a first pair of opposed walls and a second pair of opposed walls attached to each other and extending upwardly from the floor to define a unitary construction;

a bail member having a support portion, the bail member selectively movable among a nest position, a first stack position in which the support portion is a first distance from the floor and a second stack position in which the support portion is a second distance from the floor, the second distance being less than the first distance, wherein the support portion of the bail member is not positioned directly over the floor in the nest position and is positioned directly over the floor in the first stack position and the second stack position; and mounting portions on the first pair of opposed side walls for receiving the bail member, the mounting portions including a non-linear opening defining a first pivot axis and a second pivot axis about which the bail member pivots, wherein the bail member is pivotable about the first pivot axis when the bail member is in the nest position and in the first stack position, and the bail member is pivotable about the second pivot axis when the bail member is in the second stack position, wherein the first pivot axis is a third distance from the floor, the third distance less than the first distance and greater than the second distance and wherein the second pivot axis is positioned inwardly of the first axis.

28. The container of claim 27 wherein the support portion of the bail member is closer to a centerline of the container parallel to the first pivot axis when the bail member is in the second stack position than when the bail member is in the first stack position.

29. The container of claim 28 wherein the mounting portion also includes a rigid projection extending into the non-linear opening such that the bail member can not slide from the one pivot axis to the other pivot axis.

30. The container of claim 28 wherein the second pivot axis is at a fourth distance from the floor, the fourth distance not greater than the third distance.

31. The container of claim 30 wherein the non-linear opening has a substantially constant width along an arcuate path.

32. The container of claim 28 wherein the support portion of the bail member is positioned to contact an underside of the floor of a similar container stacked on the container when the bail member is in the first stack position and the second stack position, and wherein the support portion of the bail member is positioned to permit the floor of the similar container to nest within the first and second pairs of opposed walls when the bail member is in the nest position.

33. The container of claim 27 wherein the upstanding wall structure has a flange extending at least partially around an upper edge thereof.

34. The container of claim 27 wherein the bail member is pivotable about the first pivot axis between the nest position and the first stack position.

35. The container of claim 34 wherein the support portion of the bail member is spaced away from the first pivot axis, such that the support portion travels in an arcuate path as the bail member is pivoted about the first pivot axis.

* * * * *

UNITED STATES PATENT AND TRADEMARK OFFICE

CERTIFICATE OF CORRECTION

PATENT NO. : 6,938,772 B2
APPLICATION NO. : 10/164120
DATED : September 6, 2005
INVENTOR(S) : Aiken et al.

It is certified that error appears in the above-identified patent and that said Letters Patent is hereby corrected as shown below:

IN THE CLAIMS:

Column 8, Line 45, Claim 10 please delete “or” and insert --of--.

Column 9, Line 47, Claim 20 please delete “far” and insert --for--.

Signed and Sealed this

Fourteenth Day of October, 2008

JON W. DUDAS
*Director of the United States Patent and Trademark Office*